US005226528A

United States Patent [19]

Schaffer et al.

[11] Patent Number: 5,226,528

[45] Date of Patent: Jul. 13, 1993

[54] SWITCH OPERATING MECHANISM

[76] Inventors: John S. Schaffer, 6436 W. 181st St., Tinley Park, Ill. 60477; Richard F. Holzhausser, 610 Paxton Ave., Calumet City, Ill. 60409; Naresh J. Malaviya, 1348 S. Finley, Apt. #2N, Lombard, Ill. 60148

[21] Appl. No.: 606,331

[22] Filed: Nov. 6, 1990

[51] Int. Cl.[5] ..... H01H 5/00

[52] U.S. Cl. ..... 200/400; 200/426; 200/430

[58] Field of Search ..... 200/400, 401, 426, 430, 200/410, 470, 471, 411, 414

[56] References Cited

U.S. PATENT DOCUMENTS

| | | | |
|---|---|---|---|
| 2,336,036 | 12/1943 | Rypinski | 200/426 |
| 2,820,119 | 1/1958 | Miller et al. | 200/400 X |
| 3,590,183 | 6/1971 | Leonard | 200/67 |
| 4,253,003 | 2/1981 | Evans et al. | 200/400 |
| 4,360,720 | 11/1982 | Alsch | 200/426 |
| 4,412,116 | 10/1983 | Golub | 200/155 R |
| 4,507,641 | 3/1985 | Poth | 200/400 X |
| 4,554,420 | 11/1985 | Golub | 200/11 TC |
| 4,578,551 | 3/1986 | Lin | 200/400 |
| 4,616,118 | 10/1986 | Gasnier et al. | 200/400 |

*Primary Examiner*—Henry J. Recla
*Assistant Examiner*—David J. Walczak

[57] ABSTRACT

A switch actuator includes an operator plate which provides a structure for mounting the actuator and for supporting the remaining parts. An operator shaft receives torque from an operating handle and via mechanical coupling, transmits torque to a torque plate subassembly. The torque plate compresses a torsion spring which provides temporary energy storage for the switch actuator. The torsion spring acts on a reaction plate subassembly which mechanically couples the torque generated by the spring to a rotor tube to operate the switch contacts. A spring guide subassembly maintains the spring in a predefined region to prevent the spring from deforming into a non-energy storing position during operation. The operator shaft, torque plate, reaction plate, spring guide, and spring are nested substantially concentrically about a predefined mounting axis. Left and right cam followers and a pivot lever combine to form a latch mechanism to prevent the switch actuator from changing position except when operated by a user.

32 Claims, 4 Drawing Sheets

SWITCH OPERATING MECHANISM

BACKGROUND OF THE INVENTION

This invention relates to electrical switching apparatus, and more particularly to an actuator device for an electric switch for providing high contact operating speed without regard to the speed at which the operating handle is rotated.

Contact arcing is a significant problem in high-current electric switches. Arcing may occur both during the process of closing a switch and during the process of opening the switch. A typical switch has at least one moving contact and one fixed contact. In the open position, the moving contact is in a position far removed from the fixed contact, and an insulating medium (e.g. gas, oil or a vacuum) separates the contacts. If power has not been disabled at another point in the circuit, there will typically be a difference in electrical potential between the moving and fixed contacts, but the contacts are separated by sufficient distance to establish an ionization potential which exceeds the applied voltage and no current may flow therebetween. In order to close the switch, or establish an electrical connection between the moving and fixed contacts, the moving contact is brought into mechanical and electrical engagement with the fixed contact. As the moving contact approaches the fixed contact, and the distance-sensitive ionization potential falls below the applied voltage, an arc occurs. The arc continues until the moving contact reaches the fixed contact, effectively short-circuiting the arc.

When opening a switch that controls a circuit in which current is flowing, the moving contact is removed from the fixed contact. The initial distance between the contacts is extremely small, and the potential difference between the contacts exceeds the ionization potential, again producing an arc. Once an ionized path for current is produced, the arc may continue until the path is disturbed, with the result that an arc may remain present even after the contacts are separated by a large distance.

Arcs are particularly dangerous, because if a circuit controlled by a switch is faulty, the arc may carry the entire fault current, producing extremely large amounts of heat, concentrated in a small region of the switch tank. Even when conducting lesser values of current attributed to its normal load, failure to limit the arc to a relatively short period will concentrate excessive thermal energy within this region. This may cause severe damage to the switch, and may even cause the switch to explode. It is therefore highly desirable to minimize arcing.

One solution to the arcing problem is to move the contacts extremely rapidly during opening and closing operations. Rapid contact movement minimizes the time during which the contacts are close enough for an arc to strike or be maintained. Unfortunately, human operators do not always apply (and may not be capable of applying) sufficient rapid force to the switch operating handle to achieve satisfactory contact movement speeds.

Accordingly, manufacturers of electric switching apparatus have developed actuator devices which move the contacts extremely rapidly during opening and closing operations. These devices typically receive energy supplied by user operation of an operator handle, store the energy temporarily until a predefined stored energy threshold is reached, and release the energy rapidly to drive the contacts at extremely high speed. Reference is made to U.S. Pat. Nos. 3,590,183, 4,412,116, and 4,554,420, and to McGraw-Edison Power Systems Division Catalog, Section 260–30, Page 9 (July 1971) which disclose representative known switch actuator devices.

Known switch actuators present a number of significant disadvantages. One type of prior-art actuator is known as an "over-toggle" actuator. A pivot lever is operatively connected to the contact operating shaft. The pivot lever is mounted for limited rotation about a pivot axis. One end of a resilient spring is attached to the lever and the other end of the spring is anchored to a pivotable reaction piece on the opposite side of the pivot axis. The spring may be charged in tension or compression. The spring is least charged when the lever is at the beginning of the lever's rotational range, and is most heavily charged when the lever is near the extreme of its operational range. Thus, when the lever is in any position other than at either end of its rotational range, the spring applies pressure to return the lever to one of the ends.

Typical devices of the "over-toggle" variety lack positive latching arrangements that prevent forces developed in the switch from forcing the operator shaft away from the desired position during operation. In addition, the mechanical arrangements these devices generally use are not as volumetrically efficient in transferring energy as may be desired. For a given operating force supplied by a user, these devices typically do not store sufficient energy to produce the desired rotational output, or devices with sufficient energy require undesirably large amounts of space to house the spring and energy transferring mechanism. Some devices have been developed using torsion springs to eliminate one or more of the above disadvantages, but such devices have often utilized extremely complex and expensive torsion spring designs.

In addition to the above problems, prior art "over-toggle" type actuators suffer from tolerance problems in that the precise point at which the switch contacts are released, with respect to the position of the operator handle, is often less accurately controlled. Also, the output from these actuators rotates in an opposite direction from the input. This may be confusing for switch users. In addition, the means for coupling energy or torque into and out of the actuator have typically been located outside the boundaries of the actuator. As a result, a larger volume is required to house the actuator. In addition, the means for supplying torque into the actuator typically does not include flexibility to permit angular or parallel offsets of the input shaft.

OBJECTS AND SUMMARY OF THE INVENTION

It is therefore an object of the present invention to provide a switch actuator which provides rapid contact movement while storing a larger amount of energy for a given level of operator effort.

It is another object of the invention to provide a switch actuator which provides rapid contact movement while providing an effective latch and release mechanism to prevent forces developed inside the switch from displacing the contacts and actuator from the desired position.

It is a further object of the invention to provide a switch actuator which provides rapid contact movement while precisely controlling the point at which the contacts are released with respect to the position of the operator handle.

It is yet another object of the invention to provide a switch actuator which provides rapid contact movement while using a simple and inexpensive spring design.

It is still another object of the invention to provide a switch actuator which internally provides flexible mechanical coupling to the switch operator handle to reduce the volume required to house the switch.

A switch actuator according to the present invention includes an operator plate which provides a structure for mounting the actuator supporting the remaining parts. An operator shaft receives torque from an operating handle and via mechanical coupling, transmits torque to a torque plate subassembly. The torque plate compresses a torsion spring which provides temporary energy storage for the switch actuator. The torsion spring acts on a reaction plate subassembly which mechanically couples the torque generated by the spring to a rotor tube to operate the switch contacts. A spring guide subassembly maintains the spring in a predefined region to prevent the spring from deforming into a non-energy storing position during operation. The operator shaft, torque plate, reaction plate, spring guide, and spring are nested substantially concentrically about a predefined mounting axis. Left and right cam followers and a pivot lever combine to form a latch mechanism to prevent the switch actuator from changing position except when operated by a user.

BRIEF DESCRIPTION OF THE DRAWINGS

These and other features of this invention will be best understood by reference to the following detailed description of a preferred embodiment of the invention, taken in conjunction with the accompanying drawings, in which.

DETAILED DESCRIPTION OF THE PREFERRED EMBODIMENT

Figure 1:
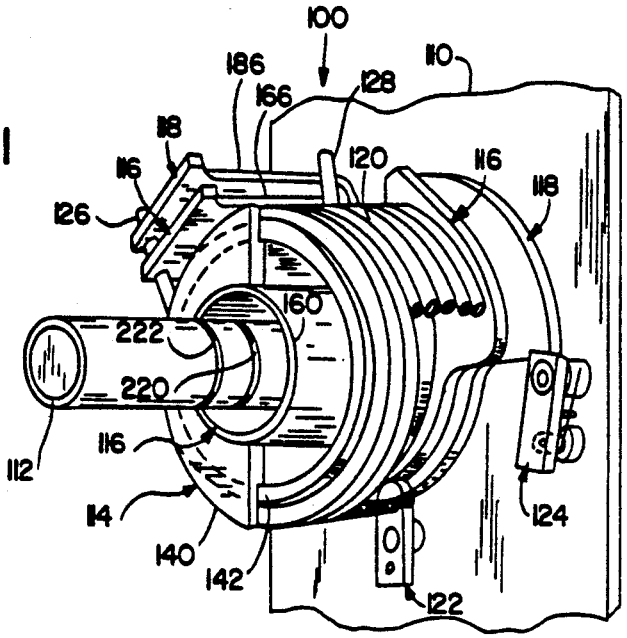
FIG. 1 is an oblique perspective view showing a preferred embodiment of a switch actuator according to the present invention.
Figure 1A:
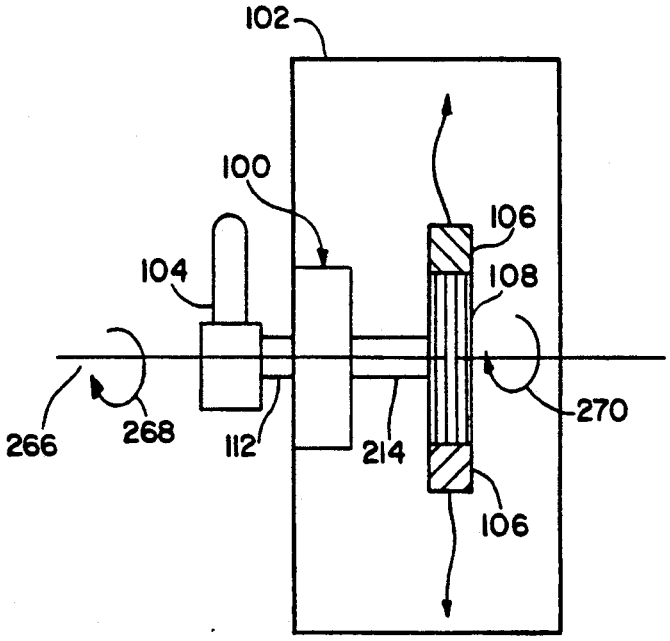
FIG. 1A is a highly simplified side elevation view of a electrical switch which employs the switch actuator of FIG. 1, provided to show an environment in which the switch actuator may be used.

FIGS. 1-4 generally show a preferred embodiment of a switch actuator 100 according to the present invention. FIG. 1A shows a highly simplified view of an electrical switch 102 as an example of an environment in which the inventive actuator 100 may be used. The switch 102 is shown as a rotary switch having a pair of stationary contacts 106 and a rotatable, conducting contact bar 108. In the closed position, the rotatable contact bar 108 physically touches both fixed contacts 106, permitting electric current to flow between the fixed contacts 106. To open the circuit, the contact bar 108 rotates to a position in which it is substantially removed from fixed contacts 106, so that current will not flow between the fixed contacts 106.

An operating handle 104 is mounted for rotation about an axis 266 as shown by arrow 268. An operator shaft 112 transfers rotational mechanical force (torque) from the handle 104 into the switch actuator 100. A rotor tube 214 transfers torque output from the switch actuator 100 to the rotatable contact 108. As the operating handle 104 is rotated by the user the switch actuator 100 receives and temporarily stores the energy produced thereby. When the handle 104 has been rotated past a predefined threshold, corresponding to a predefined amount of stored energy in the switch actuator 100, the switch actuator rapidly rotates output shaft 214, thereby also rapidly displacing the rotating contact 108, as shown by arrow 270. In contrast to some prior art actuators, the inventive switch actuator 100 provides output torque on output shaft 214 in the same direction as input torque was received on operator shaft 112. Although the foregoing discussion describes a rotatory switch having a single set of contacts, any other appropriate switch configuration adapted for rotational drive could be used.

Figure 2:
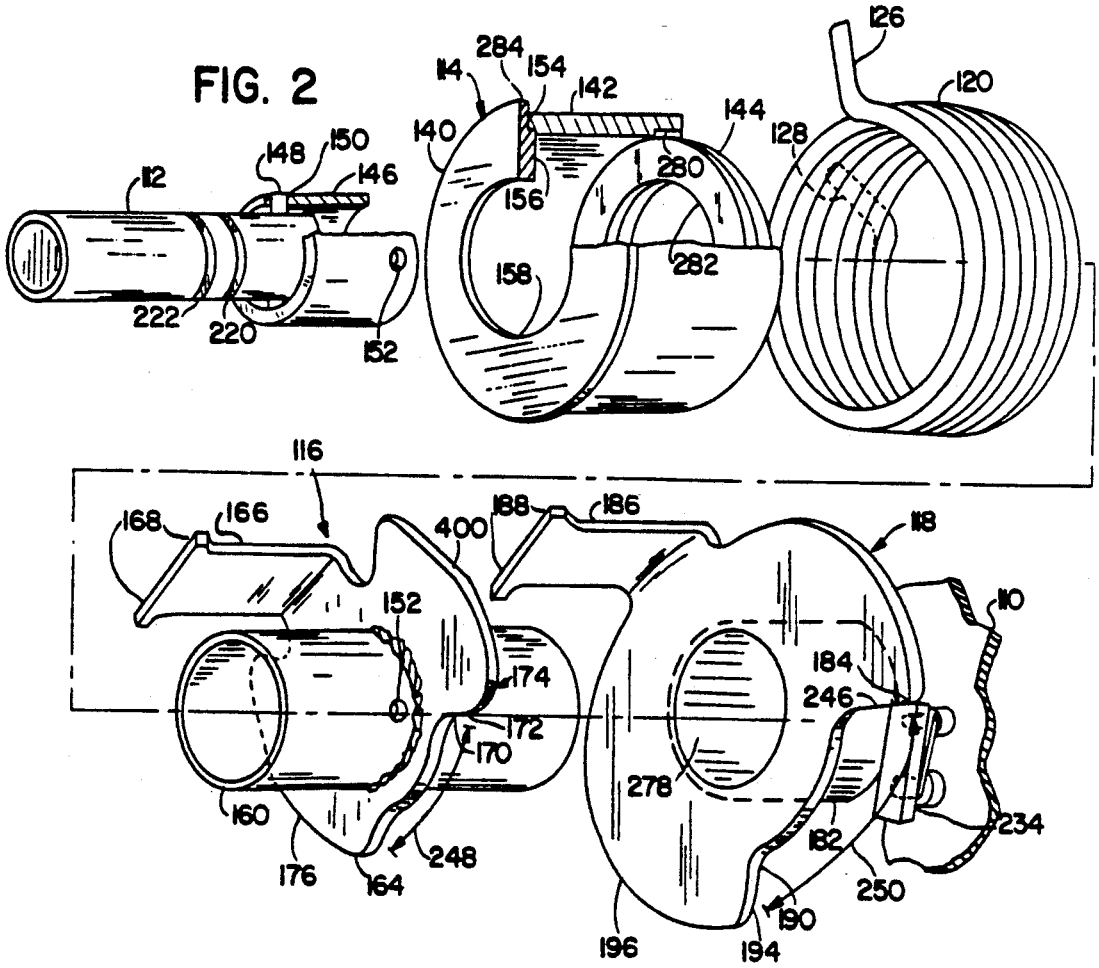
FIG. 2 is an exploded view of a portion of the switch actuator of FIG. 1.

In summary, as best seen in FIG. 2, the switch actuator 100 includes several major subassemblies. An operator plate 110 provides a structure for mounting the actuator 100 and for supporting the remaining parts. An operator shaft 112 receives torque from an operating handle 104 (FIG. 1A) and via mechanical coupling, transmits it to a torque plate subassembly 6. The torque plate 116 compresses a torsion spring 120 which provides temporary energy storage for the switch actuator 100. The torsion spring 120 acts on a reaction plate subassembly 118 which mechanically couples the torque generated by the spring to a rotor tube 214 (FIGS. 1A, 4) to operate the switch contacts. A spring guide subassembly 114 maintains the spring 120 in a predefined region to prevent the spring from deforming into a non-energy storing position during operation. As will become more apparent, the aforementioned parts are nested substantially concentrically about a predefined mounting axis.

Figure 3:
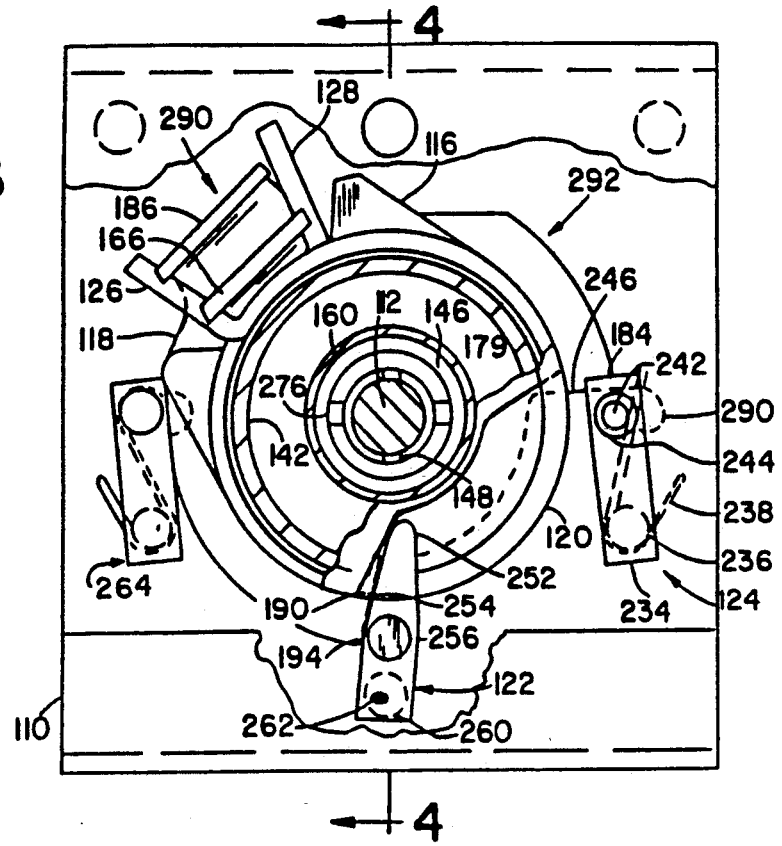
FIG. 3 is a top plan view of the switch actuator of FIGS. 1-2 in an initial position, with some portions cut away to reveal underlying parts.

As best seen in FIG. 3, the switch actuator 100 also includes a left cam follower 264, a right cam follower 124, and a pivot lever 122, which, in combination, form a latch mechanism to prevent the switch actuator 100 from changing position except when operated by a user.

As used herein, the term "front" refers to the portion of an object located closer to the switch operator handle 104—i.e. toward the left-hand sides of FIGS. 1, 1A, 2, and 4. The term "rear" refers to the portion of an object located closer to the switch contacts 106, 108—i.e. toward the right-hand sides of FIGS. 1, 1A, 2, and 4.

Figure 4:
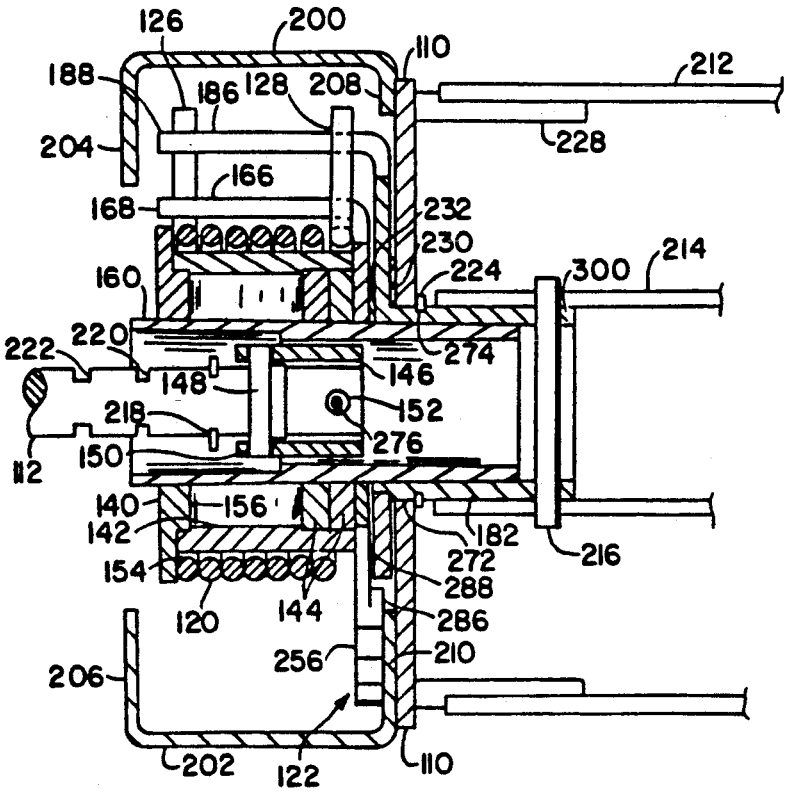
FIG. 4 is a side cross section view of the switch actuator of FIGS. 1-3 taken along the section lines 4—4 of FIG. 3.

In greater detail, as best shown in FIG. 4, the switch actuator 100 is supported by an operator plate 110. An upper mounting bracket 200 preferably extends toward the front of switch 102 to permit the operator plate 110 to be mounted to a secure structural component of the switch enclosure with an integral welded or mechanical seal (not shown). The upper mounting bracket 200 preferably has a rear attachment flange 208 by which it is conventionally attached to operator plate 110, and a front attachment flange 204 by which it is attached to the switch enclosure structural component. A lower mounting bracket 202, having front and rear attachment flanges 206, 210, is similarly constructed and attached. These could be top and bottom mounted or on the side. Likewise, the switch may be rotated. The front attachment flanges 204, 206 may be conventionally attached to the switch enclosure structural component using any suitable means. The lengths of 200 and 202 may be varied to provide angular mounts with regard to the surface of the tank or attachments to a curved surface. The brackets may be integral with operator plate 110.

The switch operator support arrangement of brackets 200, 202 has advantages over prior art switch actuators which employed a bearing mounted on the operator shaft to support the actuator. In those actuators, the operator shaft and other mechanical actuator components were required to withstand both the operating force and the forces involved in supporting the actuator mechanism. The inventive switch actuator 100 requires its moving mechanical components to withstand only the forces associated with operating the actuator.

Operator plate 110 is preferably also secured to a component of the switch mechanism itself. As best seen in FIG. 4, a suitable attachment bracket 228 is provided extending rearward of operator plate 110 for attachment to the switch mechanism support structure 212. For example, when the switch operator 100 is used in conjunction with a rotary switch as previously described, the rotary switch may have a tubular structural support 212, and attachment bracket 228 may be constructed as a short section of tube of suitable dimensions to mate with support 212 and may be attached to operator plate 110 using conventional means.

As best seen in FIGS. 1–4, operator shaft 112 is preferably a sturdy bar having a circular cross section. An adaptor tube 146 is mounted at one end of operator shaft 112 to mechanically couple the operator shaft 112 to torque plate 116. The operator shaft 112 preferably includes several longitudinally spaced grooves 220, 222 to retain means for sealing the shaft at an aperture in the switch enclosure (not shown). A pin 148 extends through the operator shaft 112 in a direction perpendicular to the long axis of the shaft and engages an opposed pair of mating apertures 150 near the front end of adaptor tube 146. The pin connection between operator shaft 112 and adaptor tube 146 permits these parts to pivot with respect to one another. The adaptor tube 146 is preferably a cylindrical tube having an interior aperture somewhat larger than the outside dimension of shaft 112 to accommodate pivoting.

Torque plate subassembly 116 comprises a cam plate 176, an operator tab 166 extending forward perpendicularly from the cam plate 176, and a cylindrical guide tube 160 extending perpendicularly through an aperture in the cam plate 176. Guide tube 160 is substantially concentrically disposed about the predefined mounting axis. The front portion of guide tube 160 confines operator shaft 112 and adaptor tube 146. A pin 276 (FIGS. 3–4) extends through the adaptor tube 146 and engages an opposed pair of mating apertures 152 in guide tube 160 to mechanically couple adaptor tube 146 to guide tube 160 and thus to torque plate 116.

Pin 276 is oriented in a direction perpendicular to both the long axis of the guide tube 160 and to pin 148, permitting operator shaft 112 to pivot about two axes with respect to guide tube 160, effectively creating a "universal joint" connection between these parts. While a "universal joint" coupling is described above, any other appropriate coupling method which tolerates deviations between the respective axes of the input and output sides of the coupling could also be used. This arrangement permits operator shaft 112 to transmit torque to guide tube 160, while eliminating the need to precisely orient operator shaft 112 on the mounting axis of guide tube 160. The coupling arrangement of the present invention provides substantial advantages because the coupling is located within the switch actuator itself. Prior art switch actuators either lacked a flexible coupling, or required a coupling means external to the actuator which required additional space in the switch enclosure or "tank". Locating the coupling arrangement within the switch actuator provides the advantages of the flexible coupling while permitting a significant reduction in the volume of the switch enclosure, as compared to previous designs.

Torque plate operator tab 166 transmits the torque received by the torque plate to spring 120. Operator tab 166 preferably includes spring retainer means 168 which extend perpendicularly to the tab 166 to prevent the spring 120 from sliding off the tab 166 during operation. Cam plate 176 is a substantially flat plate having a modified disk shape. A perimeter section 248 of the disk shape located opposite the operator tab 166 is relieved to create a pair of torque plate cam operating regions 164, 174.

Reaction plate subassembly 118 is constructed similarly to torque plate 116 and comprises a cam plate 196, an operator tab 186 extending forward perpendicularly from the cam plate 196, and a cylindrical guide tube 182 extending perpendicularly rearward from an aperture 278 in the ca plate 196. Guide tube 182 is substantially concentrically disposed about the predefined mounting axis. Guide tube 182 of reaction plate 118 has a set of notches 300 for mechanically coupling the switch rotor tube 214 to guide tube 182 and thus to reaction plate 118.

The operator plate 110 has an aperture 272 for receiving the reaction plate guide tube 182. Reaction plate 118 is mounted for rotation about the predefined mounting axis such that the reaction plate guide tube 182 extends rearward through aperture 272 and cam plate 196 is substantially parallel to operator plate 110. The reaction cam plate 196 similarly has an aperture 278 for receiving the torque plate guide tube 160. Reaction plate guide tube 182 and aperture 278 have inner diameters slightly larger than the outside dimension of torque plate guide tube 160, so that they may receive guide tube 160. Torque plate 116 is mounted for rotation about the predefined mounting axis and within reaction plate guide tube 182. Thus, the guide tubes 160 and 182 form a bearing, permitting rotation of torque plate 116 and reaction plate 118 with respect to one another.

A bearing 230 (FIG. 4) may be provided between cam plates 176, 196 to minimize friction as these parts rotate with respect to one another. Alternatively, the plates could be teflon coated. A bearing 230 (FIG. 4) may also be provided between cam plate 196 and operator plate 110 to minimize friction as the cam plate 196 rotates with respect to the operator plate 110. These bearings are preferably constructed as a thin, ring- type bearing of friction-reducing plastic. Metal sheet bearings could also be used. A retaining ring 224 (FIG. 4) is provided on reaction plate guide tube 182 to confine the reaction plate subassembly 118 in position adjacent operator plate 110. The retaining ring 224 engages a radial groove 274 in guide tube 182 near the rear side of operator plate 110 and extends far enough outside the diameter of guide tube 182 to interfere with aperture 272. Thus, once the retainer ring is installed, it prevents the reaction plate 118 from moving toward the front of the switch. A bearing similar to 230 may be used between the retaining ring 224 and the operator plate 110.

The guide tube 182 of reaction plate 118 extends rearward a substantial distance from operator plate 110 to interface with switch rotor tube 214. The switch rotor tube 214 has an inner diameter sufficiently large to permit it to slip over guide tube 182. A pin 216 (FIG. 4) is provided in switch rotor tube 214 to engage notches 300 in guide tube 182. The pin 216 and notches 300 fix guide tube 182 rotationally with respect to switch rotor tube 214, so that the switch rotor tube 214 is effectively mechanically coupled to reaction plate 118. This coupling technique permits both the switch 102 and the switch actuator 100 to be assembled separately and later joined. The "slip-in" coupling between the switch rotor tube 214 and the reaction plate guide tube 182 eliminates the need for precise longitudinal alignment of these parts. The pin 216 may be installed in switch rotor tube 214 prior to joining the switch 102 to the switch actuator 100 so that no access is required to the pin 216 once the tubes 182, 214 are slipped together. As a result, no additional holes are required in either switch support tube 212 or attachment bracket 228 to permit access to the pin 216. This maximizes the strength of these components.

In addition, guide tube 182 and switch rotor tube 214 overlap for a substantial distance so that guide tube 182 may provide partial structural support for switch rotor tube 214. This eliminates the need to support the switch rotor tube 214 with an additional bearing near the switch operator.

Torque plate 116 and reaction plate 118 are mechanically coupled by torsion spring 120, and at certain times during operation of the switch actuator 100, by pivot lever 122. This coupling will be described in greater detail in a later section. Torsion spring 120 transmits torque from torque plate 116 to reaction plate 118 via the operating tabs 166, 186. Reaction plate operator tab 186 transmits torque exerted by spring 120 to the reaction plate 118. Operator tab 186 preferably includes spring retainer means 188 which extend perpendicularly to the tab 186 to prevent the spring 120 from sliding off the tab 186 during operation. The torque plate subassembly 116 is, in turn, retained in its partially nested position within the reaction plate 118 by spring 120. Pressure from spring 120 is sufficient to ensure that it always interferes with spring retainer means 188 even during switch operation and despite any vibration which may be present.

Cam plate 196 of reaction plate subassembly 118 is a substantially flat plate having a modified disk shape. A perimeter section 250 of the disk shape located opposite the operator tab 186 is relieved to create a pair of reaction plate cam operating regions 184, 194.

The spring guide subassembly 114 is mounted concentrically around the torque plate guide tube 160 and confines the spring 120 in a predefined region so that it cannot deform into a non-energy storing configuration. The spring guide subassembly 114 comprises an upper spacer 140, a lower spacer 144, and a cylindrical guide tube 142. The spacers maintain the guide tube 142 in a proper position concentric with the predefined mounting axis. The lower spacer 144 is preferably formed as a washer having an aperture 282 slightly larger than the outer dimension of the torque plate guide tube 160 so that it may slip over the guide tube 160 and occupy a position adjacent cam plate 176. The cylindrical guide tube 142 is mounted around the lower spacer 144. The cylindrical guide tube 142 has an inner groove 280 for receiving lower spacer 144. The upper spacer 140 is mounted at the front end of the cylindrical guide tube 142. The upper spacer 140 is also formed as a washer and preferably has a groove 154 along its rear perimeter to receive the cylindrical guide tube 142. An aperture 158 permits upper spacer 140 to slip over the torque plate guide tube 160. The upper spacer 140 preferably has an overhanging flange 284 to prevent torsion spring 120 from advancing forward beyond the spacer 140. The spacers at the front and rear ends of cylindrical guide tube 142 prevent the torsion spring 120 from substantially deviating from a concentric orientation around the predefined mounting axis.

Spring guide subassembly 114 may be retained on torque plate guide tube 160 using any appropriate means. For example, a number of raised dimples (not shown) may be created on the outer surface of guide tube 160 at the junction of the guide tub with upper spacer 140. The dimples would interfere with forward movement of the spacer 140, and spacer 140 would retain the remainder of the spring guide subassembly. Regardless of the method used to retain the spring guide subassembly 114, it is desireable that guide tube 142 be free to rotate when it comes into contact with spring 120.

Spring 120 may be any appropriate torsion spring. Spring 120 has a front attachment arm 126 and a rear attachment arm 128. Spring 120 is installed over spring guide tube 142 before upper spacer 140 is installed to prevent interference from flange 284. Spring 120 is preferably constructed such that once installed, it is "precharged" about 90 degrees. In other words, in order to install spring 120, one attachment arm must be rotated one-quarter turn in the tensile direction. As best seen in FIG. 2, in its rest or uncompressed state, front attachment arm is positioned about 60 degrees clockwise of rear attachment arm 128. In FIG. 1, the spring 120 is shown in its installed state, in which the rear attachment arm is positioned on the "clockwise" side of operator tabs 166, 186, and the front attachment arm is positioned on the "counter-clockwise" side of operator tabs 166, 186. In the installed state, the front attachment arm 126 is positioned about 30 degrees "counter-clockwise" from the rear attachment arm 128. Thus, the front attachment arm 126 has been rotated about 90 degrees "counter-clockwise" (the tensile direction for that arm), accomplishing the "precharge" of the spring. Although the spring has been described above as having a precharge of about 90 degrees and as having a particular winding direction, these characteristics merely embody one example of an appropriate spring and coupling parameters. Other winding arrangements and precharge parameters could also be used.

As most clearly seen in FIG. 1, operator tabs 166, 186 fully overlap one another. In that position, spring attachment arms 126, 128 are in their closest possible locations they may occupy after the spring has been installed. Any rotation of operator tabs 166, 186 with respect to one another will necessarily increase the distance between the spring attachment arms 126, 128, causing increased tension in spring 120. Therefore, spring 120 will resist rotation of either of operator tabs 166, 186 with respect to the other in any direction.

The large diameters of the torsion spring 120 and spring guide subassembly 114 permit the use of a large guide tube on torque plate 116. This, in turn, allows the universal joint coupling between the torque plate 116 and the operator shaft 112 to be located within the torque plate guide tube 160, in the otherwise unused region inside the coil of the spring. This provides advantages over prior art switch actuators, which generally had coupling means located substantially in front of the remainder of the actuator mechanism or lacked a flexible coupling-means. By locating the coupling within the mechanism, in otherwise unused space, the present invention provides a substantial reduction in the volume of space devoted to prior art actuators incorporating similar features.

Right cam follower lever 124 is best seen in FIG. 3. Cam follower 124 comprises a cam roller 244, a lever arm 234, a pivot axle 236 for the lever arm 234, an axle 242 for roller 244, and a spring 238. Lever arm 234 is mounted for rotation on pivot axle 236, which is conventionally attached to operator plate 110. A guide channel 240 is provided in operator plate 110 to limit movement of the cam follower lever 124. Roller axle 242 is conventionally attached to lever arm 234 and extends rearward through guide channel 240 of operator plate 110. Thus, axle 242 will interfere with operator plate 110 when the axle reaches the ends of channel 240, thereby preventing pivoting of the cam follower lever beyond predefined desired limits of travel. A suitable roller 244 is mounted for rotation on axle 242. Roller 244 acts as a cam follower by riding along the cam operating surfaces 184 of reaction plate 118. Spring 238 urges cam follower lever 124 counter- clockwise so that the lever 124 may act on the cam operating surfaces 184 when they are present. A left cam follower lever 264 is provided which is identically constructed, but is urged in the clockwise direction and operates on cam surface 194 of reaction plate 118.

Pivot lever 122 is best shown in FIGS. 3–4. The lever 122 is mounted for rotation on operator plate 110 by means of a pivot axle 256. A pivot lever guide channel 260 is provided in operator plate 110 to limit the extent of rotation of pivot lever 122. A stop pin 262 extends rearward into the guide channel 260 so that the pin 262 will interfere with the walls of the guide channel when pivot lever 122 reaches the desired end of travel. As best seen in FIG. 4, pivot lever 122 has a shorter rear cam portion 286 for contact with the cam surfaces of reaction plate 118, and a longer front cam portion 288 for contact with the cam surfaces of torque plate 116. Reference numerals 252 and 254 denote cam surface locations on pivot lever 122 which will be of interest in the operational description of the invention.

Figure 5:
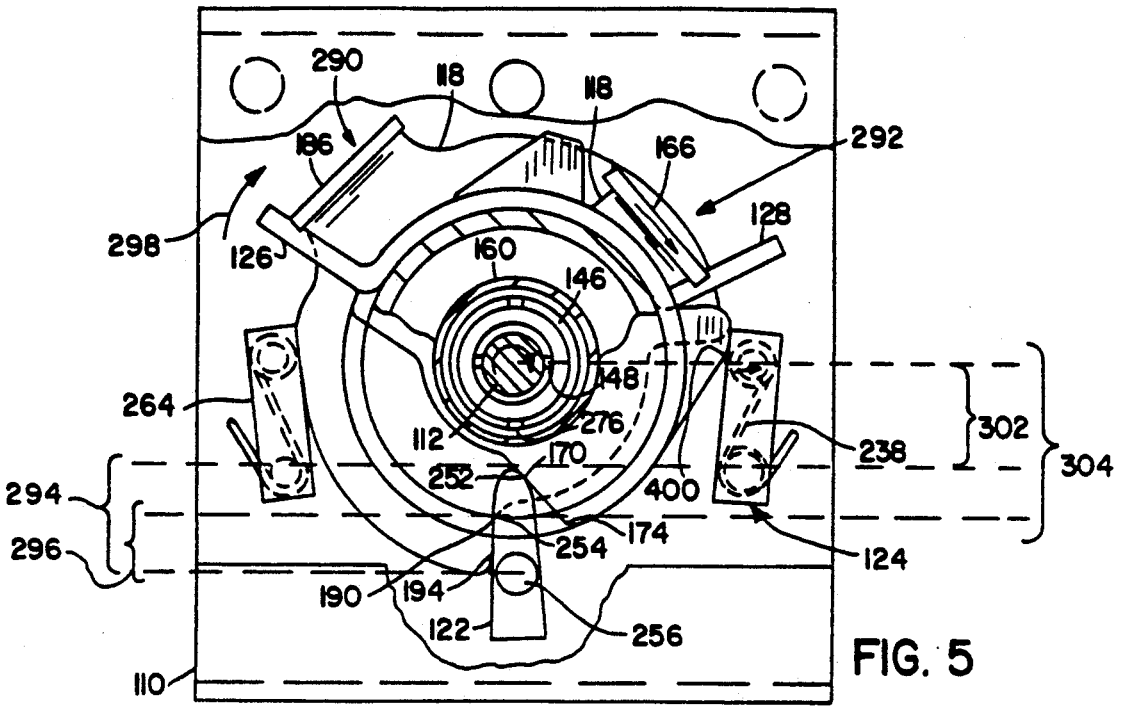
FIG. 5 is a top plan view of the switch actuator of FIGS. 1-4 showing the parts thereof in an intermediate position as they may appear during operation.
Figure 6:
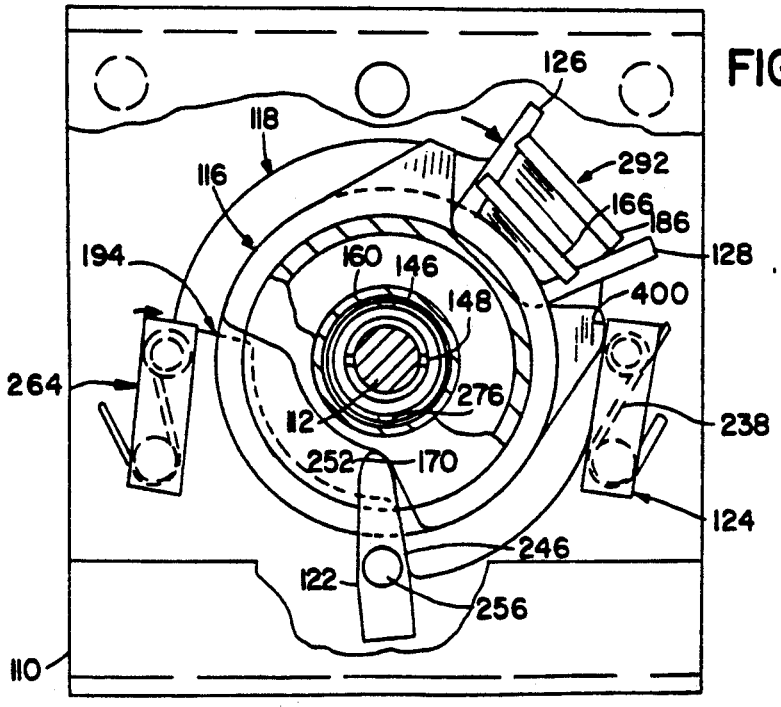
FIG. 6 is a top plan view of the switch actuator of FIGS. 1-5 showing the parts thereof in a final position as they may appear after operation.

The interaction between the torque and reaction plates 116, 118, spring 120, cam followers 124, 264, and pivot lever 122 will be most clearly seen in FIGS. 3, 5, and 6, with the aid of the following operational description of the inventive switch actuator 100. In FIG. 3, torque plate 116 and reaction plate 118 are shown in a first stable orientation. This first orientation is designated generally by the arrow 290 pointing toward operator tabs 166, 186 which may be used as convenient references for gauging the respective orientations of the torque plate 116 and the reaction plate 118. Because torque plate 116 is operatively connected to the switch operating handle 104, the orientation of torque plate 116 always corresponds to the orientation of the operating handle 104 so that if the handle rotates, so does the torque plate. Similarly, reaction plate 118 is operatively connected to the rotatable contact 108, and the orientation of the reaction plate 118 corresponds to the orientation of the switch contact 108.

In order to operate the switch 102, it is desireable to displace the rotatable switch contact 108 from its initial orientation to a target orientation about 90 degrees in the clockwise direction. Arrow 292 designates a second stable predefined position of the reaction plate operator tab 186, which corresponds to the target orientation of the rotatable contact 108. While 102 switch has been described as requiring a 90 degree clockwise throw for contact closure, the inventive actuator 100 could be applied to switches requiring counter-clockwise throws, or with some modifications, throws of other displacements, such as a 60 degree throw.

As shown in FIG. 3, reaction plate 118 is initially held in the first stable orientation by pivot lever 122 and right cam follower 124. Counter-clockwise pressure exerted by spring 238 on cam follower axle 242 urges cam roller 244 against cam operating surface 246 of reaction plate 118, so that reaction plate 118 is prevented from clockwise rotation. However, the cam operating region 194 of reaction plate 118 also abuts against pivot lever 122 at location 254. This prevents counter-clockwise rotation of reaction plate 118. As shown in FIG. 3, pivot lever 122 has pivoted clockwise so that surface 194 interacts with the pivot lever axle 256 through the wall of the lever 122. Therefore, any further counter-clockwise rotation of reaction plate 118, 124, is prohibited.

In order to initiate an operation of the switch 102, a user rotates the operating handle 104 over a predetermined angular displacement. The predetermined displacement may be any suitable amount for which the switch actuator has been constructed in accordance with the requirements of the environment in which the switch is applied. For the following operational description, it is assumed that a displacement of about 90 degrees in the clockwise direction is preferred, although the inventive switch actuator could be constructed to accommodate other displacements.

The effect of the rotation of the operating handle 104 is most clearly seen in FIG. 5, showing the state of switch actuator 100 at an intermediate point in the operating cycle. Rotation of the operating handle 104 causes rotation of torque plate 116. Operator tab 166 of torque plate 116 is shown approaching the second stable predefined position 292. Operator tab 166, in turn, causes rotation of the rear attachment arm 128 of torsion spring 120. Accordingly, in addition to the precharge energy stored in the spring 120 during its installation, the spring is now charged in tension with the energy provided by the 90 degree clockwise rotation of the operating handle 104. The front attachment arm 126 of spring 120 exerts substantial clockwise force (shown by arrow 298) on operator tab 186 of reaction plate 118, strongly urging the reaction plate 118 to rotate clockwise. However, cam follower 124 is initially located in its fully counter-clockwise "latched" position, so that cam roller 244 engages reaction plate operating surface 246, thereby prohibiting clockwise movement of the reaction plate 118.

As torque plate 116 rotates clockwise, its rear cam surface 400 comes into contact with cam roller 244. As torque plate 116 continues to rotate, its rear cam surface 400 urges the cam follower 124 to rotate clockwise toward a release position in which cam follower 124 no longer blocks the rotation of reaction plate 118. At a predefined threshold position, cam follower 124 is completely disengaged from reaction plate operating surface 246, and no components of the switch actuator 100 are acting to impede rotation of the reaction plate 118. Spring 120 exerts substantial force to urge the reaction plate 118 to rotate clockwise. However, due to forces external to the switch operator 100, such as friction between the moving and fixed contacts or other mechanical contact behavior, the rotatable contacts may be restrained from moving with respect to the fixed contacts.

Accordingly, switch actuator 100 includes a pivot lever 122 to provide additional torque which may be required to dislodge the moving contacts from the fixed contacts. Due to continued rotation of torque plate 116, its region 170 now abuts against the front cam portion 288 of pivot lever 122 as shown at location 252. With further clockwise torque plate rotation, pivot lever 122 is forced to rotate counter- clockwise about pivot axle 256. The distance between the operating location 252 and the center of rotation of pivot axle 256 is designated by reference numeral 294. As a result of the counter-clockwise rotation of pivot lever 122, its rear cam portion 286 abuts against cam operating region 190 of reaction plate 118 at location 254. Thus, the torque plate 116 uses pivot lever 122 to apply additional force to reaction plate 118 to urge the reaction plate to rotate clockwise.

As best seen in FIGS. 3 and 4, the rear cam portion 286 of pivot lever 122 is shortened, so that the operating location 254 is closer to the axis of rotation of pivot lever 122 than is operating location 252. The distance between the operating point 254 and the pivot axle 256 center of rotation is designated by reference numeral 296. Since distance 294 is greater than distance 296, a mechanical advantage is achieved. The distance between operating point 252 and the pivoting axis of the torque plate guide tube 160 is designated 302. The distance between operating point 254 and the pivoting axis of the reaction plate guide tube 182 is designated 304. Since distance 304 is greater than distance 302, an additional mechanical advantage is achieved. In addition to its operation as a lever, the pivot lever 122 also performs as a wedge due to its angular interaction with reaction plate 196. Therefore, pivot lever 122 provides a substantial mechanical advantage, effectively increasing the force the torque plate 116 can apply to the reaction plate 118 for a given amount of user effort.

The additional force provided via pivot lever 122 on reaction plate 118 is sufficient to overcome mechanical resistance offered by the contacts along with any other forces external to the switch operator. Under great pressure from torsion spring 120, the reaction plate rapidly rotates in a clockwise direction to the second predefined stable orientation. Rotation of the reaction plate drives switch rotor tube 214 to move the now freed rotatable switch contact 108 to the desired target position.

As best seen in FIG. 6, both the torque plate 116 and the reaction plate 118 come to rest in their second predefined stable orientations, as indicated by the locations of operator tabs 166, 186 at position 292. Pivot lever 122 acts as a stop to prohibit further clockwise rotation of torque plate 116 and reaction plate 118. Left cam follower 264 rotates clockwise into a position in which it interferes with reaction plate 118 at cam operating region 194, thereby preventing substantial counter-clockwise rotation of the reaction plate. Although small clearances may be provided between pivot lever 122 and reaction plate operating surface 246, and between left cam follower 264 and reaction plate 12 cam operating region 194, reaction plate 118 is now essentially trapped between pivot lever 122 and left cam follower 264. Therefore, the reaction plate 118 is secured from further movement until a reverse switch operation is initiated by a user by rotating operating handle 104 counter-clockwise. Torsion spring 120 applies counter-clockwise force to retain torque plate 116 in the second stable position. Operation of the switch actuator 100 in the reverse direction is essentially a "mirror-image" of its operation in the forward direction.

The above-described embodiment of the invention is merely one example of a way in which the invention may be carried out. Other ways may also be possible, and are within the scope of the following claims defining the invention.

What is claimed is:

1. An actuator adapted to be used with an electric switch having at least one movable contact comprising:

means for receiving energy from a rotational mechanical movement;

means for storing said energy received by said receiving means;

means for transmitting said energy from said storage means to said movable contact;

said transmitting means being movable by said energy from said storage means for moving said contact;

means exclusively responsive to said energy receiving means for selectively prohibiting movement of said energy transmitting means; and force application means responsive to said receiving means and separate from said energy storage means for transmitting additional energy from said energy receiving means to said energy transmitting means for moving said contact;

said energy receiving means, energy storage means, and energy transmitting means being substantially concentrically mounted for rotation about a common axis.

2. A switch actuator as in claim 1, wherein said energy storing means comprises a resilient material.

3. A switch actuator as in claim 2, further comprising guide means mounted concentrically about said axis and between said resilient material and said energy receiving means to confine said resilient material to a predefined range of energy storing shapes.

4. A switch actuator as in claim 1, wherein said energy storing means is a spring.

5. A switch actuator as in claim 1, further comprising guide means mounted concentrically about said axis and between said energy storing means and said energy receiving means.

6. A switch actuator as in claim 1, wherein said means for prohibiting movement comprises means responsive to said energy receiving means for prohibiting movement of said energy transmitting means except when said energy receiving means occupies a predefined range of angular positions.

7. A switch actuator as in claim 1, wherein said responsive means for prohibiting movement of said energy transmitting means includes:

a cam follower adapted for substantially radial movement with respect to said axis;

a resilient means for urging said cam follower into engagement with said energy transmitting means;

and said additional force application means.

8. A switch actuator as in claim 7, wherein said resilient means exerts a force to urge said cam follower into a position where it resists movement of said energy transmitting means; and said additional force application means, responsive to said energy receiving means, applies a force to overcome the force exerted by said resilient means to permit rotation of said energy transmitting means.

9. A switch actuator as in claim 1, further comprising a rotatable operator shaft means operatively associated with said energy receiving means.

10. A switch actuator as in claim 9, further comprising means for rotationally coupling said operator shaft means to said energy receiving means, said coupling means being at least partially contained within said energy receiving means.

11. A switch actuator as in claim 1, wherein said additional force application means receives force from said energy receiving means and applies said force to said energy transmitting means; and said additional force application means provides a mechanical advantage to increase the force applied to said energy transmitting means.

12. A switch actuator as in claim 1, wherein said additional force application means comprises a pivot and a lever adapted for rotation about said pivot.

13. A switch actuator as in claim 12, wherein:

said energy receiving means comprises a first cam surface for applying force to said lever;

said energy transmitting means comprises a second cam surface for receiving force from said lever; and said second cam surface is located radially closer to common axis than said first cam surface, whereby a mechanical advantage is achieved to increase said force received by said energy transmitting means.

14. A switch actuator as in claim 12, wherein said energy receiving means comprises at least one cam surface for applying force to said lever.

15. A switch actuator as in claim 12, wherein said energy transmitting means comprises at least one cam surface for receiving force from said lever.

16. A switch actuator as in claim 12, wherein said energy receiving means comprises a first cam surface for applying force to said lever;

said energy transmitting means comprises a second cam surface for receiving force from said lever; and said second cam surface is located radially closer to common axis than said first cam surface, whereby a mechanical advantage is achieved to increase said force received by said energy transmitting means.

17. A switch actuator as in claim 12, wherein:

said lever comprises a first cam surface for engaging said energy receiving means;

said lever comprises a second cam surface for engaging said energy transmitting means; and said second cam surface is located radially closer to said pivot than said first cam surface, whereby said lever provides a mechanical advantage to increase said force applied to said energy transmitting means.

18. A switch actuator as in claim 12, wherein:

said lever comprises first and third opposed cam surfaces for engaging said energy receiving means;

said lever comprises second and fourth opposed cam surfaces for engaging said energy transmitting means; and said second and fourth cam surfaces are located radially closer to said pivot than said first and third cam surfaces, whereby said lever provides a mechanical advantage to increase said force applied to said energy transmitting means.

19. An actuator adapted to be used with an electric switch having at least one movable contact comprising:

means for receiving energy from a rotational mechanical movement;

means for storing said energy received by said receiving means;

means for transmitting said energy from said storage means to said movable contact;

said transmitting means being movable by said energy from said storage means for moving said contact;

said energy receiving means, energy storage means, and energy transmitting means being substantially concentrically mounted for rotation about a common axis;

said energy transmitting means comprising:

a substantially flat plate;

a tubular member extending from said plate in a first direction;

a tab extending from a peripheral edge of said plate in a direction parallel to and opposite the first direction, said tab engaging said energy storage means for receiving energy from said energy storage means.

20. A switch actuator as in claim 19 wherein said energy transmitting means further comprises means for receiving a portion of said energy receiving means.

21. A switch actuator as in claim 19, wherein said energy storing means comprises a resilient material.

22. A switch actuator as in claim 21, further comprising guide means mounted concentrically about said axis and between said resilient material and said energy receiving means to confine said resilient material to a predefined range of energy storing shapes.

23. A switch actuator as in claim 19, wherein said energy storing means is a spring.

24. A switch actuator as in claim 19, further comprising guide means mounted concentrically about said axis and between said energy storing means and said energy receiving means.

25. A switch actuator as in claim 19, further comprising a rotatable operator shaft means operatively associated with said energy receiving means.

26. A switch actuator as in claim 25, further comprising means for rotationally coupling said operator shaft means to said energy receiving means, said coupling means being at least partially contained within said energy receiving means.

27. An actuator adapted to be used with an electric switch having at least one movable contact comprising:

means for receiving energy from a rotational mechanical movement;

means for storing said energy received by said receiving means;

means for transmitting said energy from said storage means to said movable contact;

said transmitting means being movable by said energy from said storage means for moving said contact;

a rotatable operator shaft means operatively associated with said energy receiving means;

means for rotationally coupling said operator shaft means to said energy receiving means, said coupling means being at least partially contained within said energy receiving means;

said energy receiving means, energy storage means, and energy transmitting means being substantially concentrically mounted for rotation about a common axis;

said coupling means comprising:

an adaptor;

first pivot means for operationally connecting said operator shaft means to said adapter;

second pivot means for operationally connecting said adaptor to said energy receiving means;

said first pivot means permitting pivoting of said operator shaft with respect to said adaptor about a first subsidiary axis substantially perpendicular to said common axis;

said second pivot means permitting pivoting of said adaptor with respect to said energy receiving means about a second subsidiary axis substantially perpendicular to said common axis;

said first and second subsidiary axes being substantially orthogonal.

28. An electrical switch comprising:

a handle for operation by a user;

a switch actuator operatively connected to said handle; and at least one movable electrical contact;

said switch actuator comprising:

means for receiving energy from a rotational mechanical movement;

means for storing energy received by said receiving means;

means for transmitting energy from said energy storing means to said movable electrical contact;

said transmitting means being movable by said energy from said storage means for moving said contact;

a rotatable operator shaft means operatively associated with said energy receiving means and said operating handle; and means for rotationally coupling said operator shaft means to said energy receiving means, said coupling means being at least partially contained within said energy receiving means;

said energy receiving means, energy storing means, and energy transmitting means being substantially concentrically mounted for rotation about a common axis;

said coupling means comprising:

an adaptor;

first pivot means for operationally connecting said operator shaft means to said adapter;

second pivot means for operationally connecting said adaptor to said energy receiving means;

said first pivot means permitting pivoting of said operator shaft with respect to said adaptor about a first subsidiary axis substantially perpendicular to said common axis;

said second pivot means permitting pivoting of said adaptor with respect to said energy receiving means about a second subsidiary axis substantially perpendicular to said common axis;

said first and second subsidiary axes being substantially orthogonal.

29. An actuator for an electrical switch comprising:

a rotational axis;

an operator shaft means mounted for rotation about said axis;

a torque receiving plate mounted for rotation about said axis and at least partially surrounding said operator shaft means;

a reaction plate mounted for rotation about said axis and at least partially surrounding said torque receiving plate;

a torsion spring mounted for rotation about said axis and at least partially surrounding said torque plate;

means responsive to the position of said torque receiving plate for selectively permitting rotation of said reaction plate when said torque receiving plate occupies a predefined range of angular positions; and means for rotationally coupling said operator shaft means to said torque receiving plate, said coupling means being at least partially contained within said torque receiving plate;

said coupling means comprising:

an adaptor;

first pivot means for operationally connecting said operator shaft means to said adapter;

second pivot means for operationally connecting said adaptor to said torque receiving plate;

said first pivot means permitting pivoting of said operator shaft means with respect to said adaptor about a first subsidiary axis substantially perpendicular to said common axis;

said second pivot means permitting pivoting of said adaptor with respect to said torque receiving plate about a second subsidiary axis substantially perpendicular to said common axis;

said first and second subsidiary axes being substantially orthogonal.

30. A method adapted to be used for actuating an electric switch having at least one movable contact comprising the steps of:

fixing a switch drive shaft in a predetermined angular position;

rotating an operating handle to provide mechanical energy;

transmitting said mechanical energy to an energy receiving means to cause it to rotate;

storing said mechanical energy in an energy storage means at least partially surrounding said energy receiving means; and transmitting said stored energy to said switch drive shaft to operate said movable contact; and releasing said switch drive shaft responsive exclusively to said energy receiving means when said energy receiving means reaches a predefined angular position; and transferring additional energy from said energy receiving means to said energy transmitting means by means of a force application means which is separate from said energy storage means and which is actuated responsive to said energy receiving means.

31. An electrical switch comprising:

an operating handle, a switch actuator operatively connected to said handle, and at least one movable electrical contact;

said switch actuator having:

means for receiving energy from a rotational mechanical movement;

means for storing energy received by said receiving means, means for transmitting energy from said energy storing means to said movable electrical contact, and said transmitting means being movable by said energy from said storage means for moving said contact;

means responsive to said handle for selectively prohibiting movement of said energy transmitting means;

said energy receiving means, energy storing means, and energy transmitting means being substantially concentrically mounted for rotation about a common axis;

said energy transmitting means having:

a plate member, a first structural drive member extending from said plate, a second structural drive member operatively connected to said movable electrical contact for causing said contact to move, and coupling means between said first and second drive members;

said coupling means having:

a pin attached to one of said first and second structural drive members extending substantially perpendicular to said common axis, and at least one notch means on a remaining one of said first and second structural drive members for engaging said pin.

32. An actuator for an electrical switch comprising:

a rotational axis;

an operator shaft means mounted for rotation about said axis;

a torque receiving plate mounted for rotation about said axis and at least partially surrounding said operator shaft means;

a reaction plate mounted for rotation about said axis and at least partially surrounding said torque receiving plate;

a torsion spring mounted for rotation about said axis and at least partially surrounding said torque plate;

means responsive to the position of said torque receiving plate for selectively permitting rotation of said reaction plate when said torque receiving plate occupies a predefined range of angular positions;

a first drive member means operatively attached to at least one contact of an electric switch for moving such contact;

a second drive member means extending from said reaction plate; and means for coupling energy from said second drive member means to said first drive member means;

said coupling means comprising:

a pin attached to one of said drive member means and extending substantially perpendicular to said rotational axis; and at least one notch means on a remaining one of said drive member means for engaging said pin.

* * * * *